US009186811B2

(12) United States Patent
Gehrer et al.

(10) Patent No.: US 9,186,811 B2
(45) Date of Patent: Nov. 17, 2015

(54) MOISTENING SYSTEM FOR PRESSES

(75) Inventors: Udo Gehrer, Würselen (DE); Roland Hicker, Bochum (DE); Johannes Hicker, Duisburg (DE)

(73) Assignee: BRAV-O-TECH GMBH, Duisburg (DE)

( * ) Notice: Subject to any disclaimer, the term of this patent is extended or adjusted under 35 U.S.C. 154(b) by 193 days.

(21) Appl. No.: 13/881,681

(22) PCT Filed: Oct. 28, 2011

(86) PCT No.: PCT/EP2011/069003

§ 371 (c)(1),
(2), (4) Date: Jun. 27, 2013

(87) PCT Pub. No.: WO2012/056007

PCT Pub. Date: May 3, 2012

(65) Prior Publication Data

US 2013/0270742 A1 Oct. 17, 2013

(30) Foreign Application Priority Data

Oct. 29, 2010 (DE) ..... 10 2010 049 777

(51) Int. Cl.
*B27N 3/18* (2006.01)
*B27M 1/02* (2006.01)

(52) U.S. Cl.
CPC .. *B27M 1/02* (2013.01); *B27N 3/18* (2013.01); *B27N 3/186* (2013.01)

(58) Field of Classification Search
None
See application file for complete search history.

(56) References Cited

U.S. PATENT DOCUMENTS

| | | | | |
|---|---|---|---|---|
| 3,056,718 | A * | 10/1962 | Saums et al. | 162/179 |
| 6,312,540 | B1 | 11/2001 | Moyes | |
| 6,368,528 | B1 | 4/2002 | Whelan et al. | |
| 6,599,456 | B1 * | 7/2003 | von Haas | 264/120 |
| 7,220,375 | B2 | 5/2007 | von Haas et al. | |
| 7,856,779 | B2 | 12/2010 | Moyes | |
| 2002/0046805 | A1 | 4/2002 | Moyes | |
| 2003/0224122 | A1 | 12/2003 | Lopez | |

FOREIGN PATENT DOCUMENTS

| | | | |
|---|---|---|---|
| DE | 6605232 | U | 4/1970 |
| DE | 90 17 332 | U1 | 3/1991 |
| DE | 19744547 | A1 | 4/1999 |
| DE | 19754024 | A1 | 6/1999 |

(Continued)

*Primary Examiner* — Mary F Theisen
(74) *Attorney, Agent, or Firm* — Dardi & Herbert, PLLC.; Peter S. Dardi

(57) ABSTRACT

The invention relates to a moistening system (1) for presses (100) for compressing material cakes (200) mixed with binding agents, preferably continuously operating presses (100), in particular for producing composite panels, preferably engineered wood boards, comprising a first moistening agent application device. The first moistening agent application device (3) comprises a first application roll (7), which can be set from above against the material cake (200) conveyed by a conveyor unit (300) of the press, at least one first dosing roll (9), which can be set against the first application roll (7), and a first moistening agent bath (11). The at least one first dosing roll (9) is immersed in the first moistening agent bath (11) for taking up moistening agent and comprises at least one wiper roll (13), which can be set against each first dosing roll (9) and by means of which the amount of moistening agent taken up by each first dosing roll (9) can be adjusted.

21 Claims, 3 Drawing Sheets

(56) References Cited

FOREIGN PATENT DOCUMENTS

Figure 1:
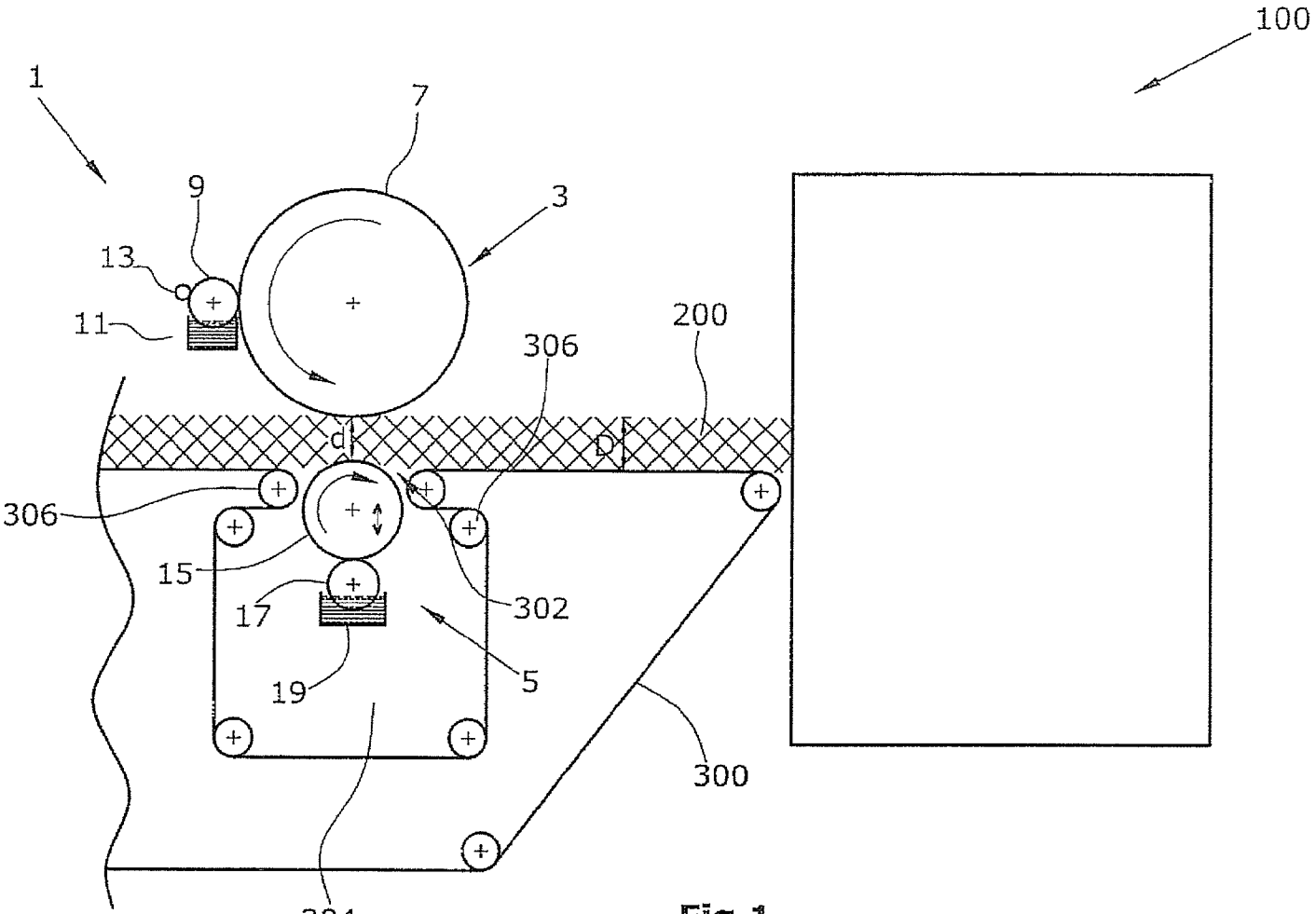

| | | | |
|---|---|---|---|
| DE | 20 2005 009 342 | U1 | 9/2005 |
| DE | 102006034098 | A1 | 1/2008 |
| DE | 10 2006 058 612 | A1 | 6/2008 |
| EP | 0 492 320 | A1 | 7/1992 |
| EP | 1 508 414 | A2 | 2/2005 |
| JP | 08-173871 | A | 7/1996 |

* cited by examiner

MOISTENING SYSTEM FOR PRESSES

CROSS REFERENCE TO RELATED APPLICATIONS

This application is a national stage filing of PCT application number PCT/EP2011/069003 filed on Oct. 28, 2011, which claims priority to German patent application number 10 2010 049 777.0 filed on Oct. 29, 2010, both of which are incorporated herein by reference.

The present invention refers to a moistening system for presses used to compress material cakes mixed with binding agents, preferably continuously operating presses, in particular for the production of composite panels, preferably engineered wood boards.

The invention further refers to a continuously operating press with such a moistening system, as well as to a method for producing compressed composite panels, and to a moistening agent for the production of composite panels.

With presses for the production of composite panels, it is known to moisten the material cake during or immediately before compression, so as to permeate the material by means of a vapor burst and to thereby transport heat into the interior of the material cake so as to accelerate the setting of the binding agent inside the material cake.

From EP 1 508 414 A2, it is known, for example, to apply water vapor to one side of the material cake in the press, where it is attempted to introduce only small amounts of vapor if possible, so as to prevent the binding agent from being washed out and to allow for a pressing operation that is as short as possible.

It is known from DE 10 2006 058 612 A1, to moisten the material cake prior to compression, using vapor.

Such moistening is disadvantageous in that metering the moistening agent is possible only very inaccurately due to the application of the moistening agent in a vapor state.

Moreover, the application of vapor generally comes with relatively high losses of moistening agent. Vaporization further causes condensate formation at machine parts, from which the condensed moistening agent can then drip onto the material cake. This may affect the pressed panel optically or may lead to disadvantages with respect to process engineering.

Therefore, it is an object of the present invention to provide a moistening system for presses of the type mentioned above, with which a very accurate metering of the moistening agent is possible and a minimum possible loss of moistening agent is ensured.

Further, it is intended that the moistening system allows for a good permeation of the material cake with vapor, if possible.

The object is achieved with the features presented in Applicant's claims.

The moistening system of the invention for use in presses for compressing material cakes mixed with binding agent, preferably continuously operating presses, in particular for the production of composite panels, preferably engineered wood boards, comprises a first moistening agent application device. The first moistening agent application device includes a first application roll, capable to be set from above against the material cake conveyed by a conveyor means of the press. At least one first dosing roll can be set against the application roll. The at least one dosing roll is immersed in a first moistening agent bath to take up moistening agents. At least one wiper roll can be set against each first dosing roll, by which the amount of moistening agent taken up by each of the first dosing rolls can be adjusted.

By providing a first application roll, it is possible to transfer the moistening agent onto the material cake in an advantageous manner. Since the moistening agent is applied in liquid form and is applied directly from the application roll onto the material cake, the loss of moistening agent occurring during the application is extremely low.

Moreover, the application roll and the dosing roll adapted to be set against the application roll allow for an exact dosing of the amount of moistening agent transferred onto the material cake. Thereby, the moisture required for a fast compression and a high surface quality can be transferred onto the material cake. By applying the moistening agent on the material cake, the moistening agent initially remains on the surface of the material cake or in the portion of the material cake near the surface. This effect can even be supported by providing additives in the moistening agent, which bind the humidity locally.

When the material cake enters the press, a sudden evaporation occurs because of the high content of moisture at the surface, so that a vapor burst occurs through the material cake. Thereby, a particularly good heat penetration of the material cake is possible. When the vapor burst occurs, free OH groups can also be formed which may be advantageous in activating a binding agent. Further, due to the good heat penetration of the material cake caused by the vapor burst, the setting of the binding agent is accelerated, in particular inside the material cake. The moisture at the surface further causes an improved surface smoothness of the finished compressed panel, whereby the grinding tolerance is smaller during the further processing. Moreover, an improved surface smoothness has the effect that the pores at the surface of the panel are lesser, so that a barrier effect occurs with respect to lacquers applied later on. Thus, lacquers applied later do not penetrate too deep into the panel, so that the lacquer consumption is considerably lower.

Due to the improved surface smoothness, the panel an even be printed without a filler being applied before to improve the surface smoothness.

Even if a filler is applied before printing, a substantially smaller amount of filler is necessary for producing a good surface smoothness than is the case in prior art. Lacquer consumption is reduced by the fact that a thinner white layer and a thinner decorative lacquer layer are required to obtain a satisfying print result.

In a preferred embodiment of a moistening system of the invention, a first dosing roll is provided, with a plurality of wiper rolls being arranged at the first dosing roll across the width of the first dosing roll such that the amount of moistening agent taken up by the first dosing roll can be adjusted differently across the width of the first dosing roll.

Here, the wiper rolls are preferably arranged offset with respect to each other and overlapping at the edge portions of the wiper rolls. By providing a plurality of wiper rolls, each adapted to be set against the first dosing roll, the amount of moistening agent taken up by the dosing roll can be adjusted differently across the width of the dosing roll. It may be provided, for example, that at the centre of the dosing roll a lesser amount of moistening agent is wiped off via the wiper roll than in the edge portions and that, correspondingly, a greater amount of moistening agent is transferred onto the centre of the material cake. Thereby, it is possible, for example, to counteract a deformation of the material cake, e.g. the so-called plate effect.

The arrangement of the wiper rolls with a mutual offset, with the wiper rolls overlapping in the edge zones, makes it possible to ensure that a uniform transition of the moistening agent amount can be adjusted without regions being formed on the dosing roll and between the wiper rolls, in which the moistening agent accumulates.

The moistening system of the invention may provide a second moistening agent application device comprising a second application roll and at least one second dosing roll, the second application roll being adapted to be set from below against the material cake transported by the conveyor unit of the press, and comprises a second moistening agent bath, the at least one second dosing roll being immersed in the second moistening agent bath to take up moistening agent.

By providing a second moistening agent application device adapted to be set against the material cake from below, it becomes possible to moisten the material cake also from below, so that a moistened layer of the material cake is formed at the upper and lower surfaces or the respective surface region of the material cake.

Thereby, when the material cake is compressed, a further vapor burst is generated that is directed into the material cake from below, so that an improved heat penetration of the material cake is obtained. Further, unilateral moistening of the material cake can cause deformation effects that can be counteracted by moistening from below.

Since the second moistening agent application device comprises a second application roll, it is possible, as with the first moistening agent application device, to also transfer the moistening agent onto the material cake from below in a manner very well dosed.

In an embodiment of the invention it is provided that the first and/or the second dosing roll are screen rolls, wherein the first and/or the second dosing roll preferably have a resiliently flexible surface and/or surface structure with a stochastic pattern. Such dosing rolls can take up the liquid moistening agent in an advantageous manner and can transfer the same onto the material cake in an advantageous manner. A resiliently flexibly surface of the dosing rolls causes a particularly advantageous transfer of the moistening agent onto the material cake. It has shown that a surface structure with a stochastic pattern causes a particularly uniform moistening agent transfer onto the material cake.

The second moistening agent application device may be arranged in an opening in the conveyor unit of the press.

It can be provided, in particular, that the second application roll is arranged below the first application roll, the distance between the first application roll and the second application roll preferably being adjustable such that the distance is less than the thickness of the material cake. By the arrangement of the second application roll below the first application roll, in can be ensured in an advantageous manner that the material cake is supported when it is moistened by the first moistening agent application device and the second moistening agent application device and does not run the risk of breaking at the opening in the conveyor unit in which the second moistening agent application device is arranged. By arranging the second application roll below the first application roll and by providing a distance between the first and the second application roll that is less than the thickness of the material cake, it is achieved that the material cake is compressed as it passes between the first and second application rolls.

Upon leaving the first and second moistening agent application devices, the material cake relaxes so that, as the same relaxes, moistening agent applied on the surface from above and from below, is drawn into the material cake due to a suction effect caused thereby. Thus, the material cake shows a so-called "sponge effect".

It may be provided in one embodiment of the invention that the second application roll is movable orthogonally to the material cake such that the opening in the conveyor unit of the press, in which the second moistening agent application device is arranged, is closable, wherein, preferably, the second moistening agent application device is movable to realize the orthogonal movement of the second application roll. This is advantageous in that moistening system of the invention can also be used for only a unilateral moistening of the material cake. In this case, the second application roll or the second moistening agent application device can be moved away from the material cake so that the opening in the conveyor unit of the press can be closed. Thereby, it can be ensured that, for example, with a loosely strewn material cake that has not been pre-compacted before, a breaking of the material cake cannot occur, since the opening in the conveyor unit of the press can be closed, so that the conveyor unit is provided under the material cake in a continuous manner.

Due to the movable second application roll, it is further possible to advantageously adjust the distance between the first and second application rolls.

In a particular embodiment of the invention it is provided that the first application roll of the first moistening agent application device has a larger diameter than the second application roll of the second moistening agent application device, the ratio of the diameter of the first application roll to the diameter of the second application roll preferably being between 1.3 and 2.5. Such a ratio has proven particularly advantageous.

Due to the first application roll being designed larger than the second application roll, the first application roll forms a larger contact surface with the material cake so that the second application roll can advantageously press against the material cake from below. Further, the space for the second moistening agent application device is limited because of its arrangement in an opening in the conveyor unit of the press, so that a smaller design of the second application roll is advantageous.

The invention further provides a continuously operating press for the production of composite panels, in particular engineered wood panels, the press comprising a moistening system according to the present invention. Here, it may be provided that the conveyor unit of the continuously operating press is arranged circulating around the second moistening agent application device. This has the particular advantage that the conveyor unit arranged upstream and downstream of the second moistening agent application device always has the same speed since it is the same endless conveyor unit.

It may be provided that the conveyor unit is a conveyor belt, wherein an opening in the conveying belt is formed by two spaced deflection rolls around which the conveyor belt travels. Such a conveyor unit has proven particularly advantageous.

Here, it may be provided that the deflection rolls are adapted to be moved towards each other in order to close the opening. Thus, the opening in the conveyor unit, in which the second moistening agent application device is arranged, can be closed in a particularly simple manner. At the same time, it can be ensured advantageously that an almost uninterrupted conveyor unit is formed when the opening is closed.

The invention further provides a method for producing pressed composite panels, preferably engineered wood boards, comprising the following steps:

pre-compressing material to form a material cake, moistening the material cake from above via an application roll, applying a separating agent, pressing the material cake to form a composite panel.

The method of the invention can further include the following step:

moistening the material cake from below via an application roll.

By moistening the material cake using application rolls, the method of the invention makes it possible to advantageously ensure that the binding agent can be dosed well, while at the same time, the loss of moistening agent can be maintained very low. By moistening the material cake from below, the vapor burst, which occurs during the pressing of the material cake and which is intended to penetrate into the interior of the material cake, can further be generated in a particularly advantageous manner since the vapor burst penetrates into the material cake from above and from below. At the same time, it is possible by moistening the material cake from below to counteract deformation effects that are due to moistening.

The method of the invention further provides that the amount of moistening agent applied onto the material cake is variable across the width of the material cake, the amount of moistening agent increasing towards the centre of the material cake. Due to the variable adjustment of the amount of moistening agent, it is also possible to advantageously counteract deformation effects of the material cake which are due to moistening.

The method of the invention particularly provides that the material cake is compressed as it is moistened. After compression, the material cake is allowed to relax again and a suction effect is created that retains the moistening agent on the material cake and draws it into the material cake. This is particularly advantageous at the lower surface of the material cake, since the suction effect acts against gravity.

In particular, the method of the invention provides the use of a press according to the invention.

In the moistening system of the invention, the continuously operating press of the invention, and the method of the invention, it should be differentiated, in particular, between the application of moistening agent and the application of separating agent. After application on the material cake, the moistening means is intended to permeate into the material cake, in order to produce a vapor burst during the pressing operation that penetrates into the interior of the material cake so as to advantageously accelerate the setting of the glue there. With continuously operating presses, a separating agent is applied on the surface of the material cake immediately before the press, which agent allows for an advantageous separation of the press from the material cake downstream of the press. Therefore, the separating agent must necessarily remain on the surface of the material cake.

In the production of panels known from prior art, wood fibers are produced first which are then dried. The moisture of the material cake necessary for the pressing is adjusted either by leaving the necessary residual moisture while drying the fibers or by correspondingly moistening the fibers again after the drying process. Thereafter, the material cake is produced. In conventional production methods, the material cake has a uniform moisture of 10%, for instance. During the pressing operation, a high energy input is required to dry the material cake and thus the panel to be produced.

With the use of a moistening system of the invention or by performing the method of the invention, a directed moistening of the material cake can be effected, with the moisture remaining at the surface or in the region near the surface. The inner region of the material cake has a lower content of moisture. For instance, the interior of the material cake may have a content of moisture of 6% which is lower than the content of moisture of the material cake in the prior art method. Therefore, less energy input is required for drying the material cake. Due to the liquid remaining on the surface of the material cake, a particularly good heat transfer between the press and the material cake is achieved, whereby shorter presses or a faster passage of the material through the press are possible.

The application of moisture on the surface of the material cake, as provided by the invention, increases the content of moisture of the material cake only such that an effective vapor burst into the interior of the material cake occurs. Compared to prior art, the overall content of moisture of the material cake is lower so that a lower energy input is required, which results in a higher energy efficiency. At the same time, production can be speeded up.

According to the invention, it may be provided that the application of the moistening agent is performed very close to the press, e.g. 5 to 6 m before the press, so that a rather short distance exists between the application of the moistening agent and the press. Thereby, it can be achieved in particular that moistening agent remains in the surface region of the material cake.

The following is a detailed explanation of the invention with reference to the accompanying drawing.

Figure 2:
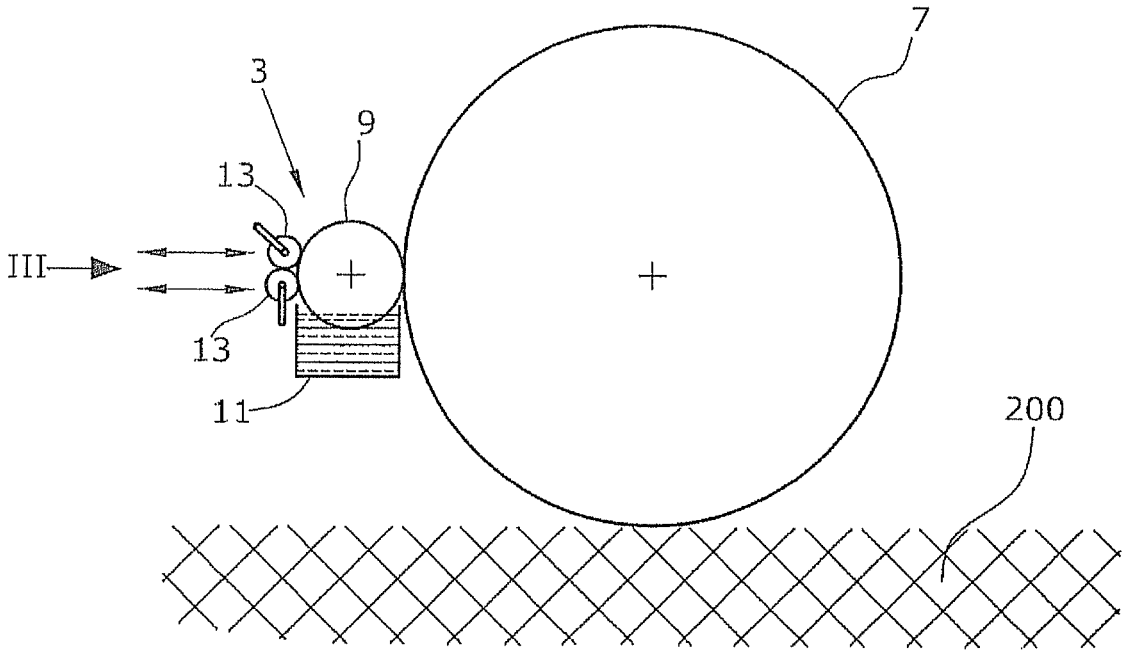
Figure 3:
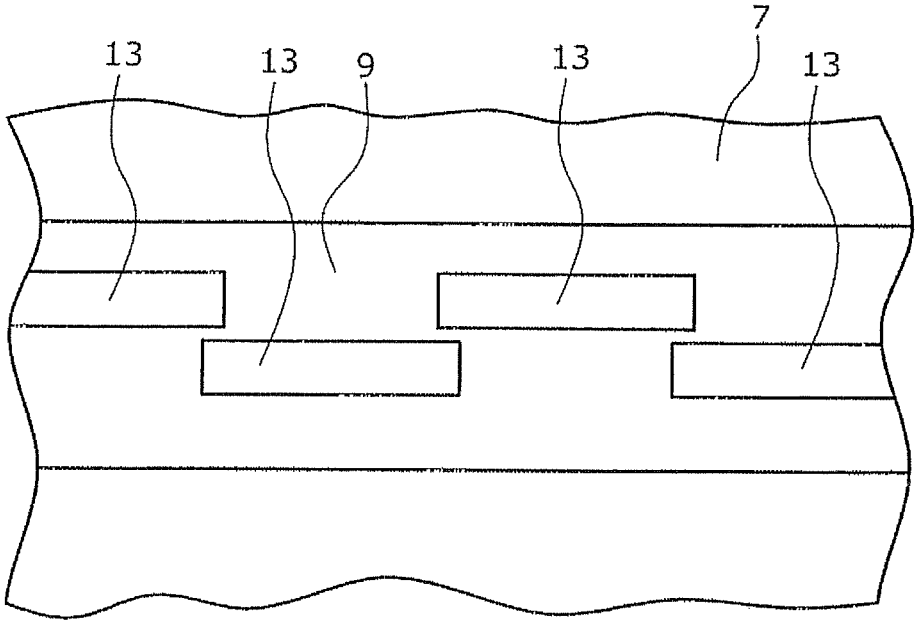
Figure 4:
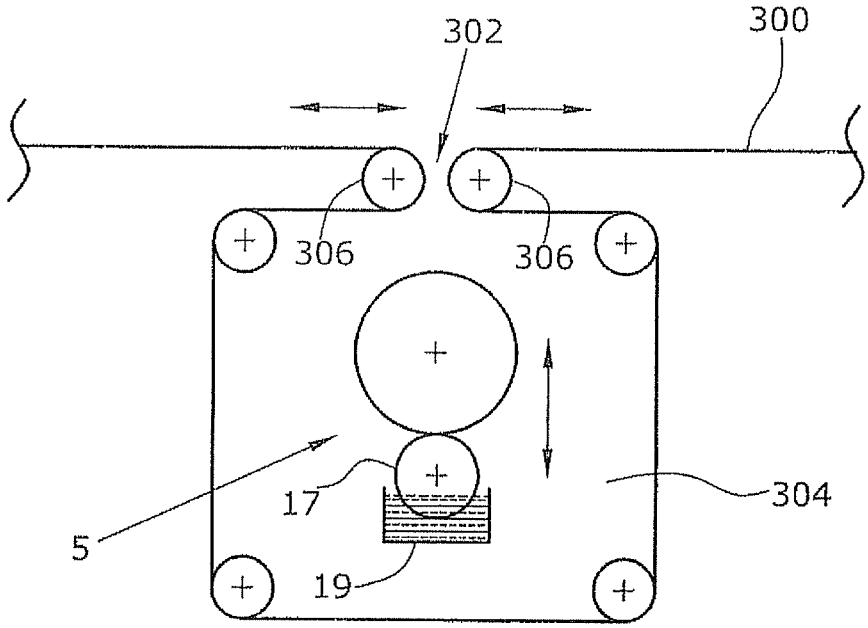

In the Figures:

FIG. 1 is a schematic side elevational illustration of a moistening system of the invention, FIG. 2 is a schematic side elevational illustration of a first moistening agent application device of the present invention, FIG. 3 is a schematic top plan view on a first moistening agent application device of the present invention, and FIG. 4 is a schematic side elevational illustration of a second moistening agent application device of the present invention in the process of closing the opening in the conveyor unit of the press.

FIG. 1 is a schematic side elevational view of a moistening system 1 of the invention for presses 100 for compressing material cakes 200 mixed with binding agents. The moistening system 1 is arranged in the region of a conveyor unit 300 of the press 100, via which the material cake 200 is fed to the press 100. The press 100 may be any optional press for producing composite panels, which is typically formed by a pressing path constituted by pressing belts, as well as a separator agent application device arranged before the pressing path.

The moistening system 1 of the present invention serves to introduce moisture into the material cake 200. The moisture is used to produce a vapor burst in the region of the pressing belts which typically are at a temperature of about 250° C., which vapor burst penetrates into the material cake and permeates the material cake. Thereby, heat is transported into the interior of the material cake, which is favorable for the setting of the binding agent in the material cake. Further, free OH groups can be formed that can activate the binding agent.

Overall, the vapor burst accelerates the setting of the binding agent.

Further, it has been found that by introducing moisture into the material cake, an improved surface smoothness of the finished composite panel can be obtained, so that, on the one hand, the grinding tolerance is lower such that less loss occurs by grinding during the finishing or further processing of the composite panels, and, on the other hand, the smooth surface has a barrier effect with respect to lacquers applied later on, so that lacquer applied cannot permeate deeply into the material. Thereby, substantially less lacquer is needed in lacquering a finished composite panel.

The moistening system 1 of the invention, illustrated in FIG. 1, consists of a first moistening agent application device 3 and a second moistening agent application device 5. The first moistening agent application device 3 moistens the upward directed surface of the material cake 200, whereas the second moistening agent application device 5 moistens the downward directed surface of the material cake 200.

The first moistening agent application device 3 consists of a first application roll 7 adapted to be set against the material cake 200 from above. The material cake 200 is conveyed by means of the conveyor unit 300 of the press 100.

A first dosing roll 9 is arranged at the first application roll 7, which dosing roll is adapted to be set against the first application roll. The dosing roll 9 immerses into a moistening agent bath 11 and takes up moistening agent and transfers the same onto the first application roll 7. In order to dose the moistening agent transferred by the dosing roll 9 onto the first application roll 7, the first dosing roll 9 comprises a plurality of wiper rolls 13, schematically indicated in FIG. 1. The arrangement of the first application roll 7, the first dosing roll 9 and the wiper rolls 13 is obvious from FIG. 2 and FIG. 3.

The second moistening agent application device 5 is arranged in an opening 302 of the conveyor unit 300 of the press 100. The second moistening agent application device 5 is formed by a second application roll 15 which transfers moistening agent onto the material cake 200 from below. For this purpose, a second dosing roll 17 is arranged which is adapted to be set against the second application roll 15. The second dosing roll 17 immerses into a second moistening agent bath 19, takes up moistening agent and transfers it onto the second application roll 15. Of course, it is possible that the amount of moistening agent transferred from the second moistening agent application device onto the material cake 200 is adjustable by means of wipers or wiper rolls arranged at the second dosing roll 17, the wipers not being illustrated in FIG. 1, As is evident from FIG. 1, the second moistening agent application device 5 is set such against the material cake 200 by means of the second application roll 15 that the distance d between the second application roll 15 and the first application roll 7 of the first moistening agent application device 3 is less than the thickness D of the material cake 200. In this manner, the material cake 200 is compressed slightly as it passes through the moistening system 1.

After having passed through the moistening system 1, the material cake 200 can relax again, wherein the relaxation of the material cake 200 causes a vacuum inside the material cake 200 which has the effect of drawing moistening agent applied on the upper and lower surfaces of the material cake 200 into the material cake 200.

In the embodiment illustrated in FIG. 1, the first application roll 7 of the first moistening agent application device is much larger than the second application roll 15 of the second moistening agent application device 5. The ratio between the first application roll 7 and the second application roll 15 may be between 1.3 and 2.5, for example.

The first application roll thus has a larger surface of contact with the material cake 200 so that, when the second application roll 15 is set against the material cake 200, it can press the same advantageously against the first application roll 7. Due to the smaller contact surface between the second application roll 15 and the material cake 200, the material cake 200 is compressed more on the lower side than at the contact surface between the first application roll and the material cake, so that the above described suction effect is particularly strong at the lower side. Thereby, the moistening agent applied onto the material cake 200 from below is advantageously drawn into the material cake 200 and held there, since the suction effect counteracts gravity.

The second moistening agent application device is arranged for vertical movement so that the second moistening agent application device can be moved away from the material cake 200 into a free space 304 formed by the conveyor unit 300.

The opening 302 in the conveyor unit 300, via which the material cake 200 is accessible from below for the second moistening agent application device, is formed by two deflection rolls 306. As illustrated in FIG. 4, the opening 302 can be closed by means of the deflection rolls 306.

FIG. 2 and FIG. 3 illustrate the first moistening agent application device 3 in schematic side elevation and in top plan view, respectively. As can be seen in FIGS. 2 and 3, the amount of moistening agent transferred from the first dosing roll 9 to the application roll 7 is adjusted at the first dosing roll 9 by means of a plurality of wiper rolls 13. The wiper rolls 13 may be designed as couch rolls 13.

As can be seen best in FIG. 3, a plurality of wiper rolls 13 are arranged offset from each other across the width of the dosing roll 9. The edged portions of the wiper rolls 13 overlap. Thereby, it becomes possible that the amount of moistening agent transferred to the application roller 7 can vary across the width of the dosing roll 9. Due to the offset arrangement of the wiper rolls 13, with the edge portions overlapping, it is ensured that no portions can be formed between the wiper rolls 13 in which a larger amount of moistening agent can accumulate.

By providing a possibility for a variable adjustment of the amount of moistening agent across the width of the dosing roll 9, it becomes possible to apply a larger amount of moistening agent in the centre of the material cake 200, for instance, than in the edge portions of the material cake 200. Further, a deformation of the material cake 200 due to the application of moistening agents can be counter-acted in this manner.

FIG. 4 illustrates the second moistening agent application device 5 in a state in which it has been moved away from the material cake 200 not illustrated in FIG. 4.

The opening 302 in the conveyor unit 300 can be closed by means of the deflection rolls 306 by moving the deflection rolls towards each other. Thereby, the opening 302 can be closed and an almost continuous conveyor surface of the conveyor unit 300 is formed. Of course, the movement of the deflection rolls 306 requires that the conveyor belt forming the conveyor unit 300 comprises buffer portions that allow deflection changes needed to move the deflection rolls 306.

By providing a movable second moistening agent application device 5 and a closing mechanism for the opening 302, it is possible to operate the present moistening system only with a unilateral moistening from above, using the first moistening agent application device. This is advantageous in particular when the material cake 200 is not or only slightly pre-compacted so that there is a risk of the cake breaking at the transition between the conveyor unit and the second moistening agent application device.

The first and second dosing rolls 9, 17 may each be a screen roll with a resiliently flexible surface and a surface structure with a stochastic pattern. Such dosing rolls have proven particularly advantageous for the transfer of moistening agent onto the application rolls.

Using a moistening system of the present invention makes it possible to implement the present method for producing pressed composite panels. The material is first pre-pressed to from the material cake 200. Thereafter, the material cake 200 is moistened from above using the first application roll 7. At the same time, the material cake 200 can also be moistened from below, using the second application roll 15. Thereafter, the application of separating agent and the pressing of the material cake 200 to form a composite panel are performed in the press 100.

The application of the moistening agent on the material cake 200 is performed at a considerable distance before the press 100 so that the moistening agent can penetrate into the interior of the material cake 200 due to, among other reasons, the suction effect caused by the temporary compression of the material cake 200 in the moistening system 1. Contrary to that, a separating agent applied in the press is applied only on the surface of the material cake 200 and is intended to remain there.

The moistening agent evaporates as the material cake is compressed, and causes a vapor burst that permeates the material cake. In the process, heat is induced into the interior of the material cake 200 so that the binding agent contained in the material cake can set in an advantageous and quick manner. At the same time, free OH groups can be formed by the vapor burst, which can activate the binding agent.

Using the moistening system 1 of the invention, the amount of the moistening agent transferred onto the material cake 200 can be dosed very well. Since the moistening agent is transferred by means of rolls, the loss of moistening agent is very low during transfer. By applying the moistening agent both from above and from below, it is at least largely avoided that deformations of the material cake 200, such as the so-called plate effect, for instance, can occur.

In order to counteract this and other deformation effects by moistening the material cake 200, the amount of moistening agent transferred onto the material cake 200 can be adjusted variably across the width of the material cake 200.

The invention claimed is:

1. A moistening system for presses for compressing material cakes mixed with binding agents, for producing composite panels, comprising a first moistening agent application device, wherein the first moistening agent application device comprises a first application roll, which can be set from above against the material cake conveyed by a conveyor unit of the press, at least one first dosing roll, which can be set against the first application roll, a first moistening agent bath, wherein the at least one first dosing roll is immersed in the first moistening agent bath for taking up moistening agent, and at least one wiper roll, which can be set against each first dosing roll and by means of which the amount of moistening agent taken up by each first dosing roll can be adjusted.

2. The moistening system of claim 1 wherein the first dosing roll has a resiliently flexible surface and/or a surface structure with a stochastic pattern.

3. The moistening system of claim 1, wherein the first dosing roll is a screen roll.

4. The moistening system of claim 1, wherein one first dosing roll is provided, a plurality of wiper rolls being arranged at the first dosing roll across the width of the first dosing roll such that the amount of moistening agent taken up by the first dosing roll can be adjusted variably across the width of the first dosing roll, the wiper rolls.

5. The moistening system of claim 4 wherein the wiper rolls are arranged with a mutually offset and overlapping each other in the edge portions of the wiper rolls.

6. The moistening system of claim 1, characterized by a second moistening agent application device comprising a second application roll and at least one second dosing roll, where the second application roll can be set from below against the material cake conveyed by a conveyor unit of the press, and comprising a second moistening agent bath, the at least one second dosing roll being immersed in the second moistening agent bath for taking up moistening agent.

7. The moistening system of claim 6, wherein the second moistening agent application device can be arranged in an opening in the conveyor unit of the press.

8. The moistening system of claim 7, wherein the second application roller is movable orthogonally with respect to the material cake such that the opening in the conveyor unit of the press can be closed, the second moistening agent application device being movable for the orthogonal movement of the second application roll.

9. The moistening system of claim 6, wherein the second application roll is arranged below the first application roll, the distance between the first application roll and the second application roll being adjustable such that the distance is less than the thickness of the material cake.

10. The moistening system of claim 6, wherein the first application roll of the first moistening agent application device has a larger diameter than the second application roll of the second moistening agent application device.

11. The moistening system of claim 6 wherein the second dosing roll has a resiliently flexible surface and/or a surface structure with a stochastic pattern.

12. The moistening system of claim 6 wherein the ratio of the diameter of the first application roll to the diameter of the second application roll is between 1.3 and 2.5.

13. The moistening system of claim 6 wherein the second dosing roll is a screen roll.

14. A continuously operating press for producing composite panels, comprising a moistening system according to claim 1.

15. The press of claim 14, wherein a conveyor unit is arranged circulating around the second moistening agent application device.

16. The press of claim 14, wherein the conveyor unit is a conveyor belt, the opening in the conveyor unit being formed by two spaced apart deflection rollers around which the conveyor belt circulates.

17. The press of claim 16, wherein the deflection rollers are adapted to be moved towards each other for the purpose of closing the opening.

18. A method for producing pressed composite panels, comprising the following steps:

pre-compressing material to form a material cake, moistening the material cake from above via an application roll, applying a separating agent, pressing the material cake to form a composite panel.

19. The method of claim 18, characterized by the step of moistening the material cake from below via a second application roll.

20. The method of claim 18, wherein the amount of moistening agent transferred onto the material cake is variable across the width of the material cake, the amount of moistening agent increasing towards the centre of the material cake.

21. The method of claim 18, implemented on continuously operating press for producing composite panels, comprising a moistening system for presses for compressing material cakes mixed with binding agents, wherein the first moistening agent application device comprises a first application roll, which can be set from above against the material cake conveyed by a conveyor unit of the press, at least one first dosing roll, which can be set against the first application roll, a first moistening agent bath, wherein the at least one first dosing roll is immersed in the first moistening agent bath for taking up moistening agent, and at least one wiper roll, which can be set against each first dosing roll and by means of which the amount of moistening agent taken up by each first dosing roll can be adjusted.

* * * * *